US008789805B2

(12) United States Patent
Piggott et al.

(10) Patent No.: US 8,789,805 B2
(45) Date of Patent: Jul. 29, 2014

(54) VIBRATION STABILIZATION SYSTEM FOR MULTI-COOLER

(75) Inventors: Alfred Piggott, Redford, MI (US); Simon Kehimkar, Rochester Hills, MI (US)

(73) Assignee: DENSO International America, Inc., Southfield, MI (US)

( * ) Notice: Subject to any disclaimer, the term of this patent is extended or adjusted under 35 U.S.C. 154(b) by 255 days.

(21) Appl. No.: 12/752,009

(22) Filed: Mar. 31, 2010

(65) Prior Publication Data

US 2011/0240257 A1 Oct. 6, 2011

(51) Int. Cl.

| | |
|---|---|
| ***A47G 1/00*** | (2006.01) |
| ***F28D 1/053*** | (2006.01) |
| ***F28F 9/00*** | (2006.01) |
| *F28D 1/04* | (2006.01) |

(52) U.S. Cl.

CPC ..... *F28D 1/05366* (2013.01); *F28D 1/0443* (2013.01); *F28F 9/002* (2013.01); *F28F 2265/30* (2013.01)

USPC ..... 248/560; 248/316.7; 165/67

(58) Field of Classification Search

USPC ..... 248/560; 165/67, 81, 149

See application file for complete search history.

(56) References Cited

U.S. PATENT DOCUMENTS

| | | | | | |
|---|---|---|---|---|---|
| D46,297 | S | * | 8/1914 | Smith | D8/366 |
| 1,246,325 | A | * | 11/1917 | Rohmer | 248/74.3 |
| 2,665,867 | A | * | 1/1954 | McDonald | 248/68.1 |
| 2,712,917 | A | * | 7/1955 | Flora et al. | 403/397 |
| 2,902,243 | A | * | 9/1959 | Atwood | 248/263 |
| 3,104,086 | A | * | 9/1963 | Salzmann | 248/262 |
| 3,199,823 | A | * | 8/1965 | Stall | 248/265 |
| 3,216,685 | A | * | 11/1965 | Raymond | 248/74.2 |
| 3,584,348 | A | * | 6/1971 | Soltysik | 48/68.1 |
| 3,704,851 | A | * | 12/1972 | Cormier | 248/265 |
| 4,140,294 | A | * | 2/1979 | Zwarts | 248/265 |
| D274,419 | S | * | 6/1984 | Burwell | D12/51 |
| D274,787 | S | * | 7/1984 | Cronce | D8/373 |
| D290,931 | S | * | 7/1987 | Powell | D8/373 |
| 5,121,894 | A | * | 6/1992 | Twork et al. | 248/316.7 |
| D346,108 | S | * | 4/1994 | Hannerstig | D8/368 |
| 5,596,792 | A | * | 1/1997 | Shelton | 24/336 |
| 5,674,023 | A | * | 10/1997 | Williams | 403/231 |
| 5,899,087 | A | * | 5/1999 | Lee | 62/298 |
| 5,921,520 | A | * | 7/1999 | Wisniewski | 248/316.1 |
| 5,934,019 | A | * | 8/1999 | Rotharmel et al. | 49/28 |
| 6,260,600 | B1 | * | 7/2001 | Miller | 160/38 |
| 6,263,954 | B1 | * | 7/2001 | Nakayama | 165/67 |
| D540,657 | S | * | 4/2007 | Hansort | D8/354 |
| 7,322,552 | B1 | * | 1/2008 | Lin et al. | 248/252 |
| 7,389,810 | B2 | * | 6/2008 | Harada | 165/149 |
| D593,852 | S | * | 6/2009 | Hoebeek | D8/394 |
| 7,721,791 | B2 | * | 5/2010 | Hayasaka et al. | 165/81 |
| D622,578 | S | * | 8/2010 | Kollman | D8/380 |
| 8,079,552 | B2 | * | 12/2011 | Sweigard | 248/74.2 |
| D666,478 | S | * | 9/2012 | Chou | D8/373 |
| D686,486 | S | * | 7/2013 | Densmore et al. | D8/349 |
| 2005/0121561 | A1 | * | 6/2005 | Sweigard | 248/74.2 |
| 2006/0185824 | A1 | * | 8/2006 | Harada | 165/81 |

* cited by examiner

*Primary Examiner* — Terrell McKinnon
*Assistant Examiner* — Daniel Breslin
(74) *Attorney, Agent, or Firm* — Harness, Dickey & Pierce, P.L.C.

(57) ABSTRACT

A bracket for stabilizing a heat exchanger has a base member extending between first and second ends. An aperture at the first end of the base member receives a fastener. The bracket is fixedly secured to a vehicle through the fastener. A flex zone extends between the first and second ends of the base member. The flex zone is movable between a first, relaxed position and a second, flexed position.

4 Claims, 9 Drawing Sheets

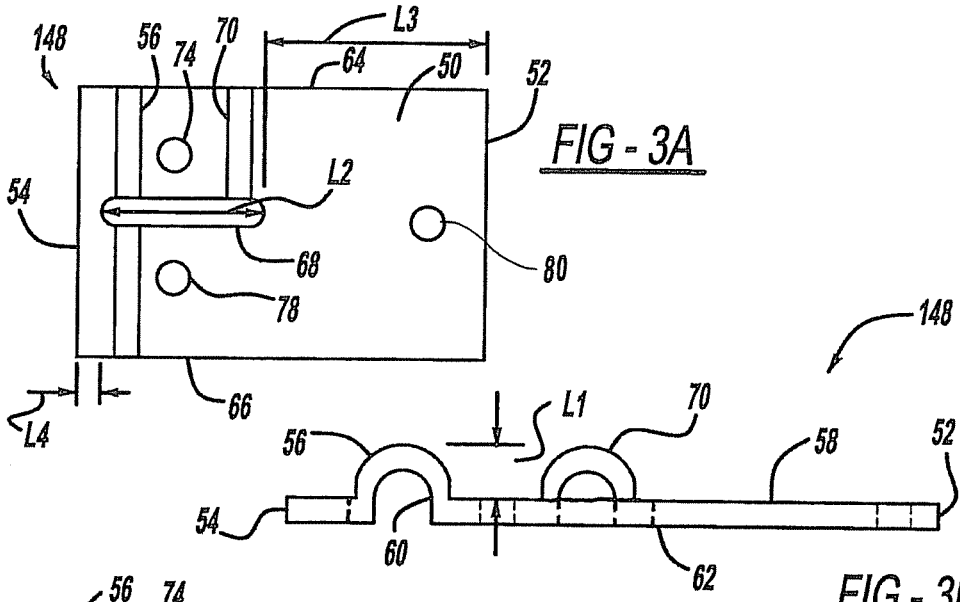
FIG - 3A
FIG - 3B
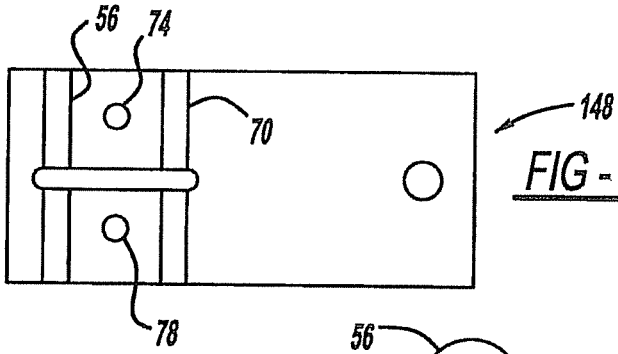
FIG - 4A
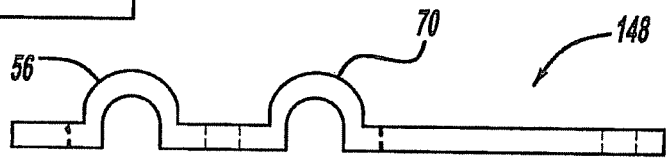
FIG - 4B
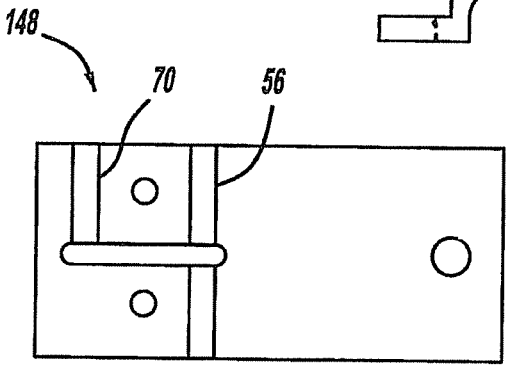
FIG - 5A
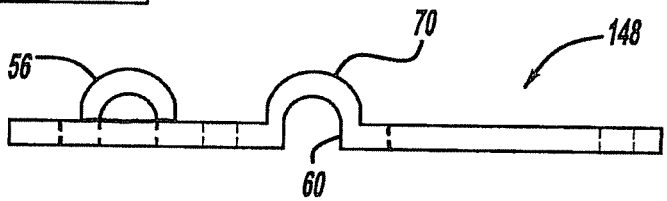
FIG - 5B

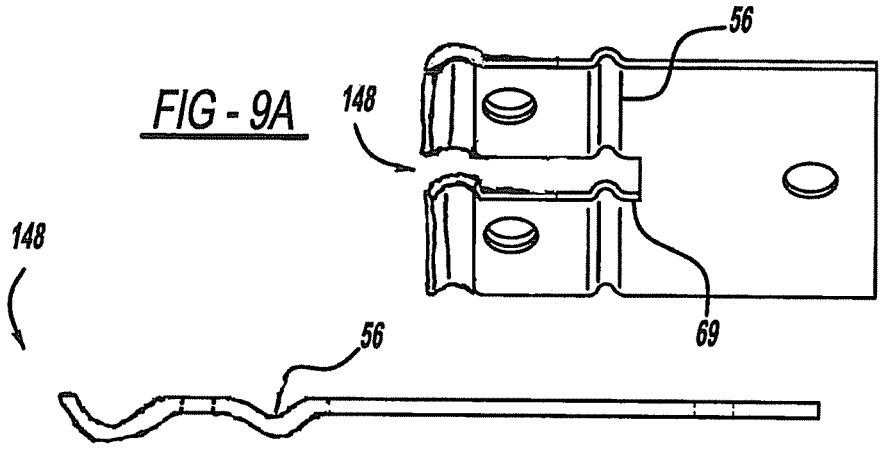
FIG - 9A
FIG - 9B
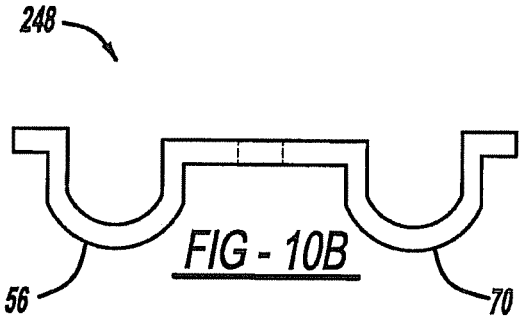
FIG - 10B
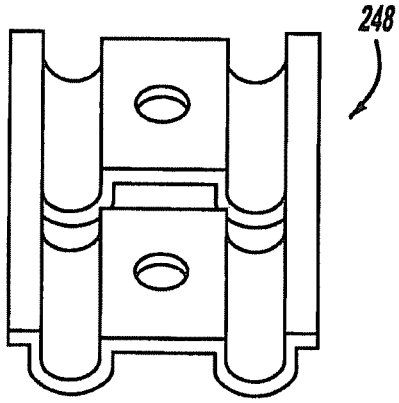
FIG - 10A
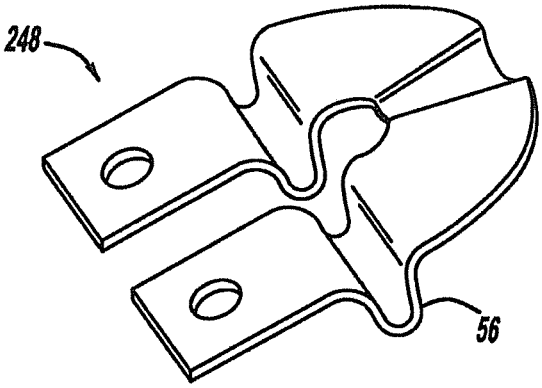
FIG - 11A
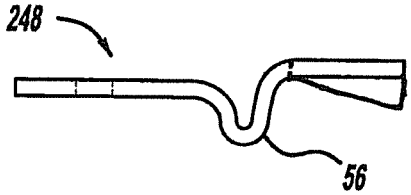
FIG - 11B

VIBRATION STABILIZATION SYSTEM FOR MULTI-COOLER

FIELD

The present disclosure relates to heat exchangers, and more particularly, to a vibration stabilization system for heat exchangers.

BACKGROUND

This section provides background information related to the present disclosure which is not necessarily prior art. Heat exchangers may be used to cool liquids that are continuously circulated through heat generating devices on a vehicle. For example, a vehicle air-conditioning system may compress a refrigerant, which is then cooled by passing through a multi-cooler.

The rate at which heating and cooling occurs depends upon the temperature, flow rate, and quantity of heat of incoming liquid supplied into and through the material of the heat exchanger relative to the temperature and rate of change of the temperature of external airflow. While external airflow may be delivered to the heat exchanger through either natural flow and/or with the assistance of a fan, the material of the heat exchanger may still increase in temperature over time. Additionally, certain heat exchangers experience internal temperature differentials related to their specific operation. For example, during operation of a multi-cooler the temperature of an oil cooler reaches a much higher temperature than that of a condenser. This higher temperature translates to higher thermal expansion in the oil cooler.

Thermal stress occurs as a result of expansion and contraction of the material of the heat exchanger during heating and cooling cycles with respect to constrained locations. For example, the multi-cooler experiences thermal stress in a header plate at locations between the oil cooler and the condenser.

A post-braze saw cut in the header plate of the multi-cooler may alleviate thermal stresses by allowing unrestrained expansion between the two portions; however, such a post-braze saw cut reduces stiffness in the multi-cooler. Current designs incorporate multiple brackets or complex-shaped brackets. What is needed, then, is a structure for reintroducing stiffness to the multi-cooler to stabilize against vibration, while providing a cost savings and a less complex design compared to current designs.

SUMMARY

This section provides a general summary of the disclosure, and is not a comprehensive disclosure of its full scope or all of its features.

A bracket for stabilizing a heat exchanger has a base member extending between first and second ends. An aperture at the first end of the base member receives a fastener. The bracket is fixedly secured to a vehicle through the fastener. A flex zone extends between the first and second ends of the base member. The flex zone is movable between a first, relaxed position and a second, flexed position.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

FIG. 3A is a plan view showing the relief bracket in accordance with an embodiment of the present disclosure;

FIG. 3B is a side view of the relief bracket of FIG. 3A;

FIG. 4A is a plan view showing the relief bracket in accordance with another embodiment of the present disclosure;

FIG. 4B is a side view of the relief bracket of FIG. 4A;

FIG. 5A is a plan view showing the relief bracket in accordance with another embodiment of the present disclosure;

FIG. 5B is a side view of the relief bracket of FIG. 5A;

FIG. 9A is a plan view showing the relief bracket in accordance with another embodiment of the present disclosure;

FIG. 9B is a side view of the relief bracket of FIG. 9A;

FIG. 10A is a perspective view showing a stabilizer in accordance with an embodiment of the present disclosure;

FIG. 10B is a side view of the stabilizer of FIG. 10A;

FIG. 11A is a perspective view showing a stabilizer in accordance with an embodiment of the present disclosure;

FIG. 11B is a side view of the stabilizer of FIG. 11A;

Corresponding reference numerals indicate corresponding parts throughout the several views of the drawings.

DETAILED DESCRIPTION

Figure 1:
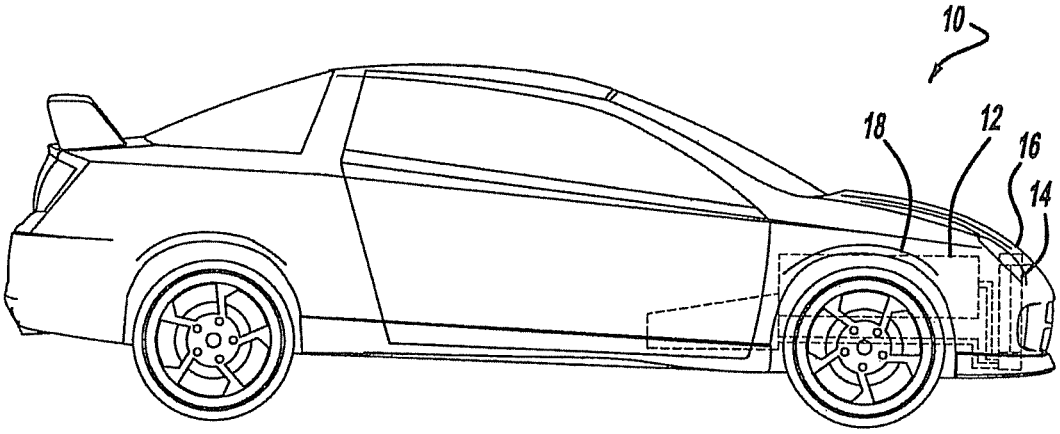
FIG. 1 is a side view of a vehicle depicting the location of an engine and heat exchanger in accordance with the present disclosure.

Example embodiments will now be described more fully with reference to FIGS. 1-21 of the accompanying drawings. It should be understood that throughout the drawings, corresponding reference numerals indicate like or corresponding parts and features. Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies will not be described in detail.

Referring now to FIG. 1, a motor vehicle 10 (e.g., automobile) may be equipped with an engine 12 and a multi-cooler 14. Multi-cooler 14 may be fixedly secured to a frame member 16 of motor vehicle 10 within an engine compartment 18. While the following description refers to the heat exchanger as multi-cooler 14, it should be understood that the teachings of the present disclosure might also be applicable to other types of heat exchangers. For example, the present disclosure may be applicable to transmission cooler heat exchangers (i.e., for cooling transmission fluid of an automatic transmission) and heater core heat exchangers (i.e., for transferring heat to a passenger compartment of a vehicle). Additionally, the teachings of the present disclosure may be applicable whether such heat exchangers are made of metal, plastic, or any other material.

Figure 2:
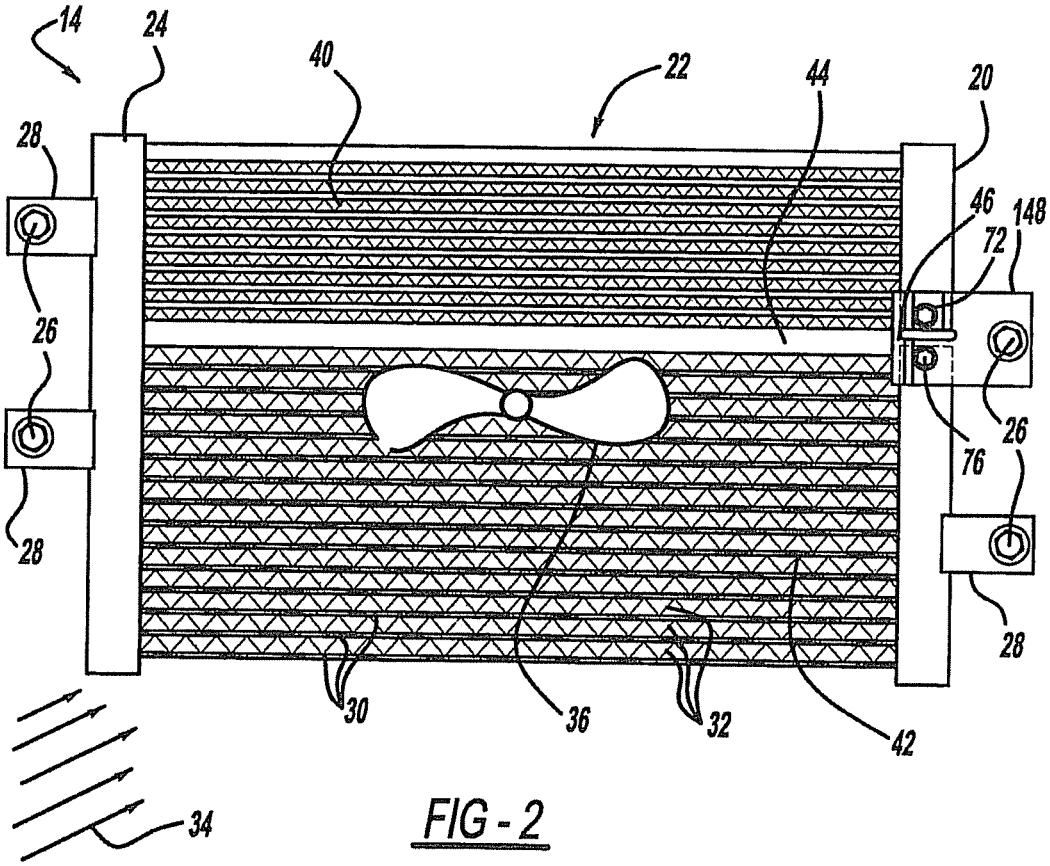
FIG. 2 is a front view of a multi-cooler depicting a location of a relief bracket in accordance with the present disclosure.
Figure 6A:
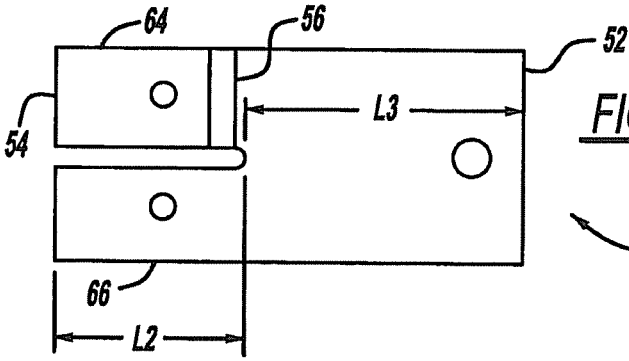
FIG. 6A is a plan view showing the relief bracket in accordance with another embodiment of the present disclosure.
Figure 6B:
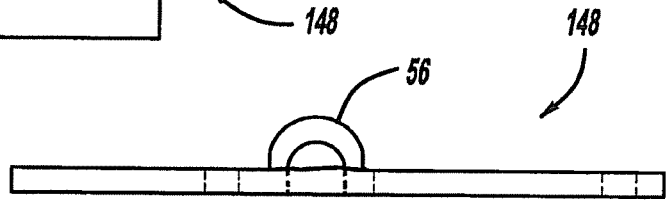
FIG. 6B is a side view of the relief bracket of FIG. 6A.
Figure 7A:
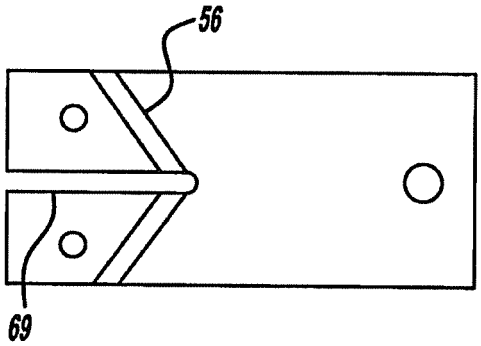
FIG. 7A is a plan view showing the relief bracket in accordance with another embodiment of the present disclosure.
Figure 7B:
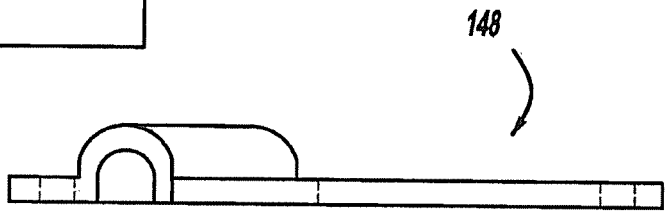
FIG. 7B is a side view of the relief bracket of FIG. 7A.
Figure 8A:
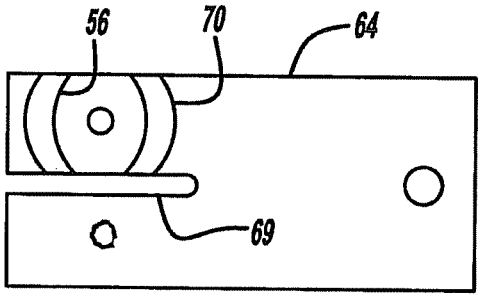
FIG. 8A is a plan view showing the relief bracket in accordance with another embodiment of the present disclosure.
Figure 8B:
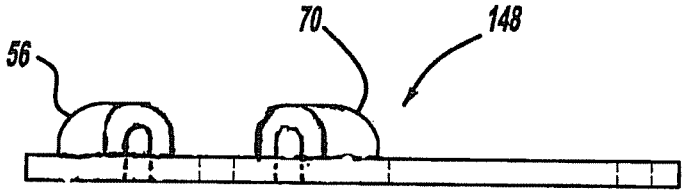
FIG. 8B is a side view of the relief bracket of FIG. 8A.

With reference now to FIG. 2, multi-cooler 14 may include an inlet manifold 20 for receiving heated and/or compressed fluid, a main core 22 for cooling the compressed fluid, and an outlet manifold 24 for expelling the cooled fluid. Multi-cooler 14 may be secured to a location within engine compartment 18 through a plurality of fasteners 26 (e.g., bolts) extending through a plurality of mounting brackets 28.

In an isochoric cooling operation, heated and/or compressed fluid may be delivered to inlet manifold 20 of multi-cooler 14 for balanced distribution to main core 22. Main core 22 may incorporate a plurality of channels 30 surrounded by a plurality of ribs or fins 32. As the heated fluid flows through channels 30 of main core 22, heat may be expelled through fins 32. External airflow delivered to multi-cooler 14 through either natural flow (as depicted by arrows 34) and/or through a mechanical device, such as by a fan 36, may also assist in removing heat from main core 22. The cooled fluid may then be passed to outlet manifold 24 before being reintroduced to vehicle 10.

Main core 22 may be divided into an oil cooler portion 40 and a condenser portion 42 so as to receive and cool a first fluid, such as oil from a motor vehicle transmission, and a second fluid, such as a refrigerant from a vehicle air conditioner. As should be understood, inlet and outlet manifolds 20, 24 may include an internal separation plate (not shown) to prevent intermixing of fluids between oil cooler portion 40 and condenser portion 42. Oil cooler and condenser portions 40, 42 of main core 22 may be rigidly joined over a distance between inlet and outlet manifolds 20, 24 through a joining operation so as to form an attachment region 44 (e.g., brazing or soldering).

Both oil cooler 40 and condenser 42 may experience temperature fluctuations after repeated operation and as the temperature in engine compartment 18 rises. The rate at which heating and cooling occurs depends upon the temperature, flow rate, and quantity of heat of incoming liquid supplied to oil cooler 40 and condenser 42 relative to the temperature and rate of change of the external temperature. Increases in temperature may result in thermal expansion of certain components of oil cooler 40 and condenser 42, while decreases in temperature may result in thermal constriction of these same components. Further, these temperature fluctuations may vary between oil cooler 40 and condenser 42 because of the alternate materials flowing therethrough. These temperature fluctuations may result in thermal stress at constrained locations of oil cooler 40 and condenser 42, such as at manifolds 20, 24. In order to alleviate these thermal stresses, inlet manifold 20 may be partitioned, such as at saw-cut region 46.

In order to retain the independent motion of oil cooler 40 and condenser 42 while still fixing multi-cooler 14 to engine compartment 18, a thermal expansion relief bracket 148 may be fastened to saw-cut region 46. Relief bracket 148 may provide for controlled movement between oil cooler 40 and condenser 42 while increasing durability and vibratory strength.

Referring now to FIGS. 3 through 9, multiple embodiments of a flexible relief bracket 148 are shown having a substantially straight planar base 50 extending from a fixed end 52 to a relief end 54. A first rib 56 may extend a predetermined distance L1 from an upper surface 58 of base 50, so as to provide a channel or concavity 60 along a lower surface 62 of base 50. First rib 56 may extend from a first side 64 of base 50 to an opposing second side 66 of base 50 and may be bisected by a relief aperture 68 (see FIGS. 3, 4, and 5) or by a slot 69 (see FIG. 9). Alternatively, first rib 56 may terminate at relief aperture 68 or slot 69 (see FIGS. 6, 7, and 8). A first planar surface 71 extends from fixed end 52 toward relief end 54 to first rib 56 and a second rib 70. A second planar surface extends from rib 70 towards relief end 54 and/or from rib 56 towards relief end 54.

Relief aperture 68 or slot 69 may be located centrally on base 50 and may extend parallel to first and second sides 64, 66 over a distance L2. Relief aperture 68 or slot 69 may begin a predetermined distance L3 from fixed end 52 and may either terminate a predetermined distance L4 from relief end 54 (e.g., aperture 68) or may extend through relief end 54 (e.g., slot 69).

In certain embodiments, a second rib 70 substantially similar to first rib 56, may also extend from first side 64 of base 50 and terminate at opposing second side 66 of base 50 (see FIG. 4). Alternatively, second rib 70 may terminate at relief aperture 68 (see FIGS. 3 and 5) or slot 69 (see FIG. 8). It should be understood that ribs 56, 70 may extend in any manner over base 50 (e.g., laterally, diagonally, curved).

Flexible relief bracket 148 may be fixedly secured to oil cooler portion 40 of multi-cooler 14 through a mounting fastener 72 (FIG. 2) extending through a first hole 74 and to condenser portion 42 through a mounting fastener 76 (FIG. 2) extending through a second hole 78. Flexible relief bracket 148 may also be secured to a location within engine compartment 18 through fastener 26 extending through a third hole 80 as described with respect to mounting brackets 28. In this way, as oil cooler 40 and condenser 42 expand and contract, flexible relief bracket 148 may stiffen the structure at saw-cut region 46 while still absorbing vibration and allowing for expansion and contraction. In particular, ribs 56, 70 may act as a flex zone by being configured so as to flex to absorb the strain between oil cooler 40 and condenser 42.

Additionally, aperture 68 allows flexible relief bracket 148 to absorb the tension and/or compression stresses generated perpendicular to the length of flexible relief bracket 148. Thus, flexible relief bracket 148 of the present design behaves as both a bracket and a stabilizer reducing and/or eliminating thermal stresses and vibration in the fore/aft direction, cross car direction, and up/down direction. This reduction of the thermal stresses and vibration increases durability and rigidity of multi-cooler 14. The design of flexible relief bracket 148 also allows for manufacture by stamping or extrusion, thereby minimizing manufacturing costs and potentially increasing the rate of production.

Design benefits of the present embodiment may also be used with heat exchanger designs that omit mounting brackets. With reference to FIGS. 10 through 11, a stabilizer 248 may be designed to be substantially similar to flexible relief bracket 148 shown in FIGS. 3 through 9 except omitting fixed end 52 and fastener 26. Stabilizer 248 achieves the same benefits as flexible relief bracket 148, but is not fixed to vehicle 10.

Figure 12A:
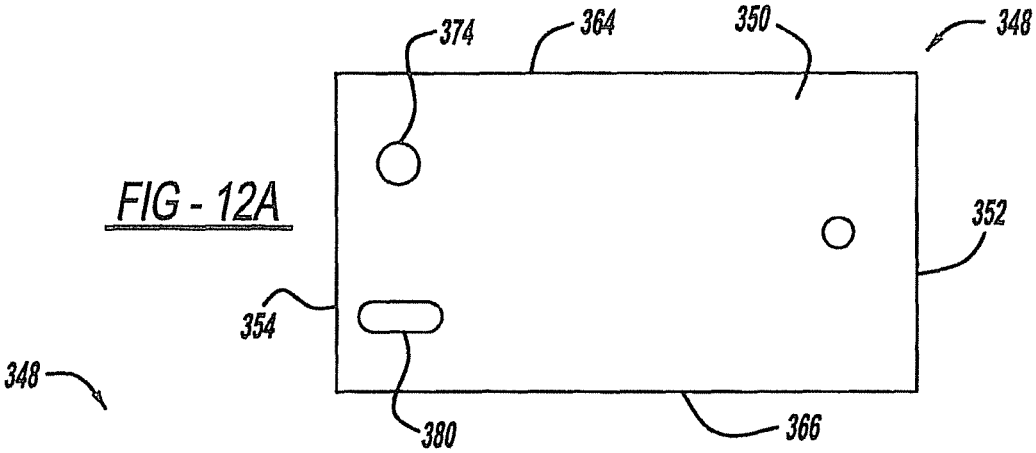
FIG. 12A is a plan view showing the relief bracket in accordance with another embodiment of the present disclosure.
Figure 12B:
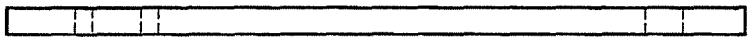
FIG. 12B is a side view of the relief bracket of FIG. 12A.
Figure 13A:
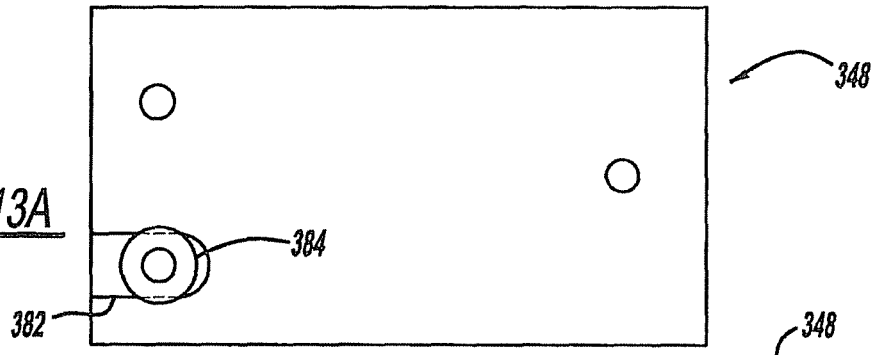
FIG. 13A is a plan view showing the relief bracket in accordance with another embodiment of the present disclosure.
Figure 13B:
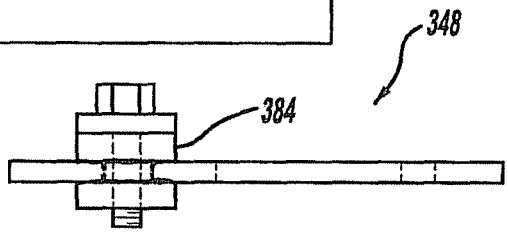
FIG. 13B is a side view of the relief bracket of FIG. 13A.
Figure 14A:
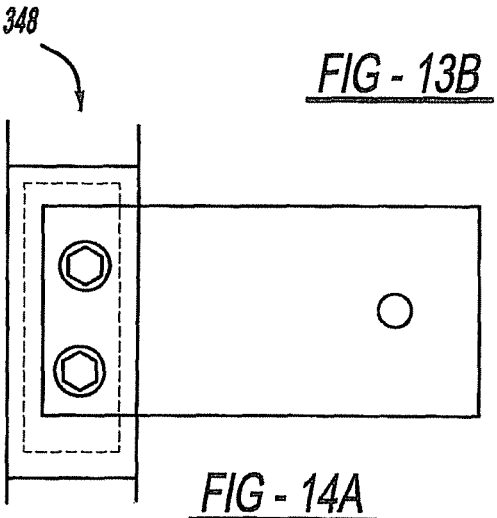
FIG. 14A is a plan view showing the relief bracket in accordance with another embodiment of the present disclosure.
Figure 14B:
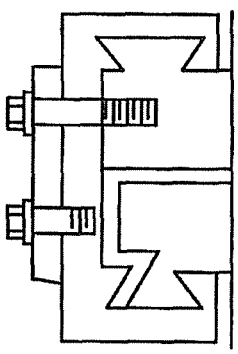
FIG. 14B is a front view of an attachment location of the relief bracket of FIG. 14A.

Other embodiments of the disclosure will be described with reference to FIGS. 12 through 14. Like or similar parts to those of the first embodiment are designated by like or similar reference numerals and will not be described in detail herein.

Multiple embodiments of a sliding relief bracket 348 are shown having a substantially straight base 350 extending from a fixed end 352 to a relief end 354. Sliding relief bracket 348 may be fixedly secured to oil cooler portion 40 of multi-cooler 14 through a pin or mounting fastener 72 (FIG. 2) extending through a first hole 374 and to condenser portion 42 through a mounting fastener 76 (FIG. 2) extending through a slotted aperture 380 (see FIG. 12) or through an open slot 382 (see FIG. 13). Sliding relief bracket 348 may also be secured to a location within engine compartment 18 through fastener 26 as described with respect to mounting brackets 28. In this way, as oil cooler 40 and condenser 42 expand and contract, sliding relief bracket 348 may stiffen the structure at saw-cut region 46 while still absorbing vibration and allowing for expansion and contraction. In particular, mounting fastener 76 may slide within slotted aperture 380 or open slot 382 so as to absorb the strain between oil cooler 40 and condenser 42. It should be understood that a rubber grommet 384 may be incorporated with slotted aperture 380 or open slot 382 so as to absorb additional thermal strain between oil cooler 40 and condenser 42.

Thus, sliding relief bracket 348 of the present design behaves as both a bracket and a stabilizer reducing and/or eliminating thermal stresses and vibration in the fore/aft direction, cross car direction, and up/down direction. This reduction of the thermal stresses and vibration increases durability and rigidity of multi-cooler 14. The design of sliding relief bracket 348 also allows for manufacture by stamping or extrusion, thereby minimizing manufacturing costs.

Figure 15A:
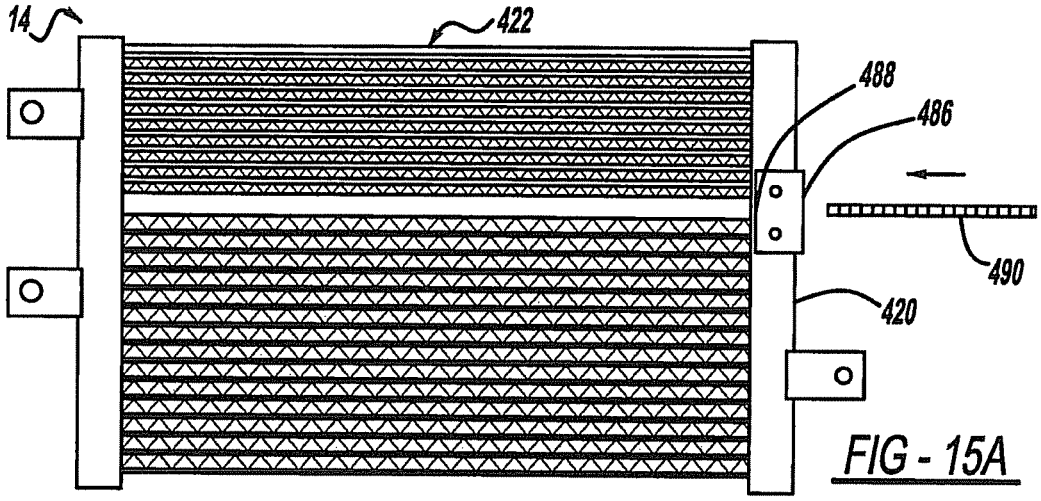
FIG. 15A is a plan view of a multi-cooler of the present disclosure before a saw-cut operation.
Figure 15B:
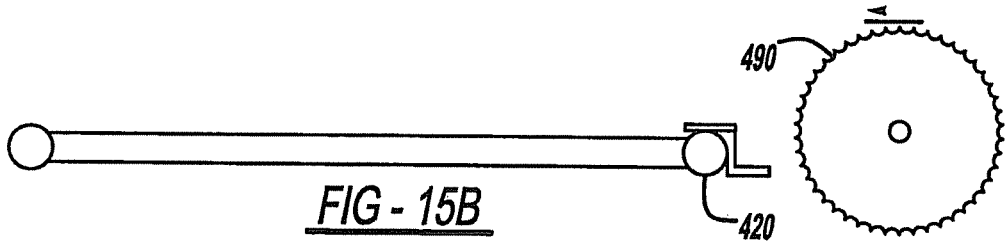
FIG. 15B is a side view of the multi-cooler of FIG. 15A.
Figure 16A:
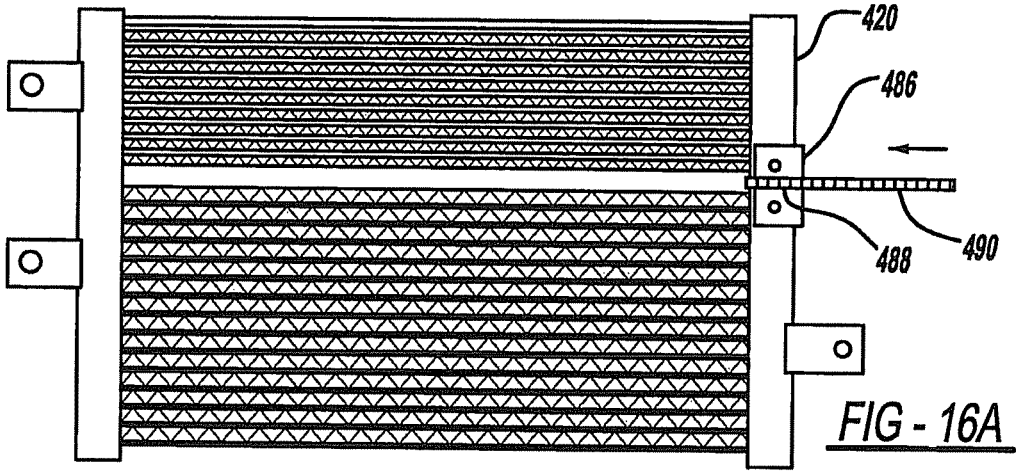
FIG. 16A is a plan view of the multi-cooler of FIG. 15A during the saw-cut operation.
Figure 16B:
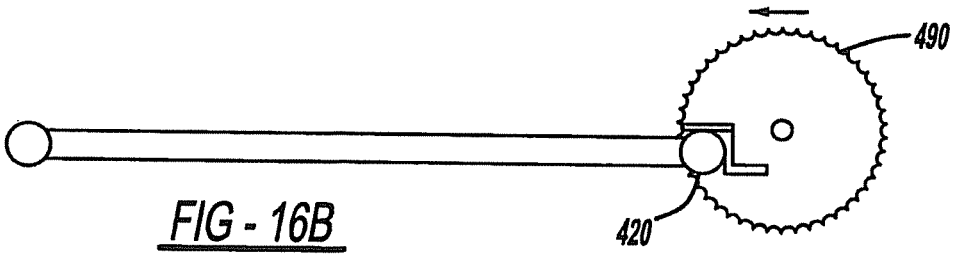
FIG. 16B is a side view of the multi-cooler of FIG. 16A.
Figure 17:
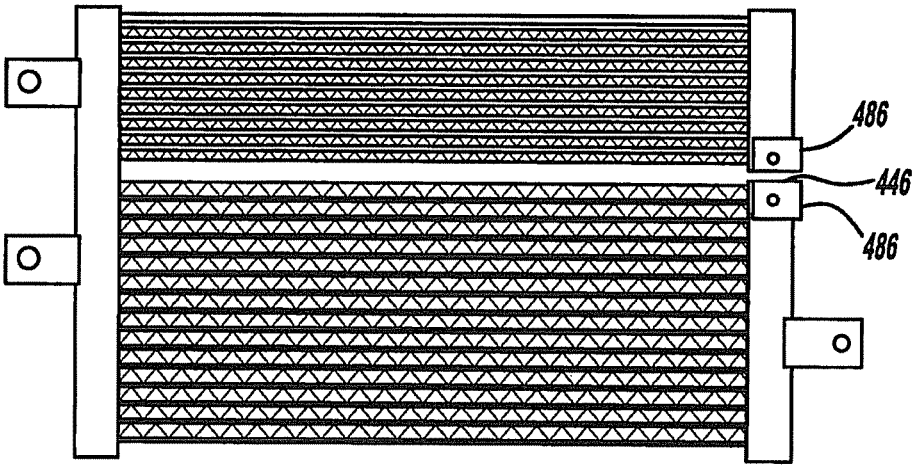
FIG. 17 is a plan view of the multi-cooler of FIG. 15A after the saw-cut operation.
Figure 18:
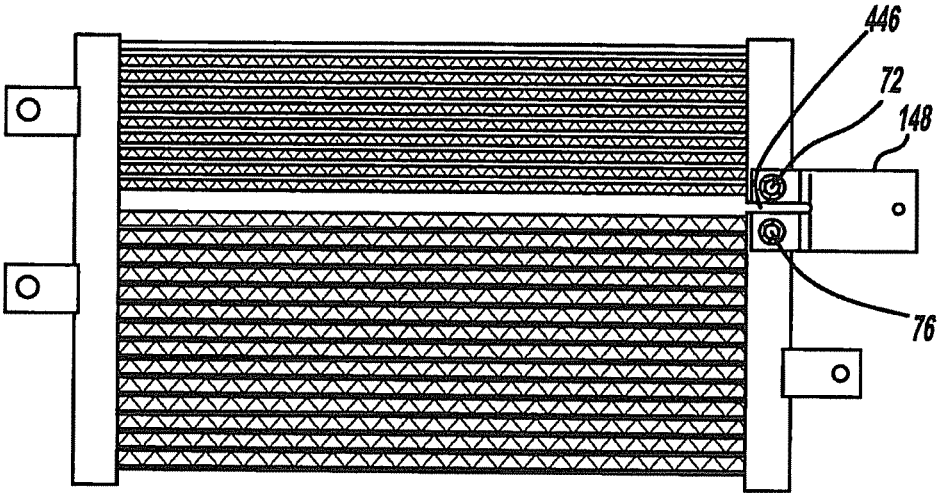
FIG. 18 is a plan view of the multi-cooler of FIG. 15A after installation of a relief bracket in accordance with the present disclosure.

A method for manufacturing multi-cooler 14 of the present disclosure will now be described with reference to FIGS. 15 through 18. In a first operation as shown in FIG. 15A, a bracket mounting block 486 is brazed onto a main core 422 of multi-cooler 14 at a saw-cut region 488 (See FIG. 15). A saw 490 is then brought into contact with bracket mounting block 486 at a mid-portion 488 of bracket mounting block 486, so as to separate both bracket mounting block 486 and an inlet manifold 420 (See FIG. 16). Saw 490 is then removed, leaving a saw-cut region 446, as shown in FIG. 17. Bracket 148, 348 of the present disclosure is then bolted to saw-cut region 446 with fasteners 72, 76 as described above (See FIG. 18).

Figure 19A:
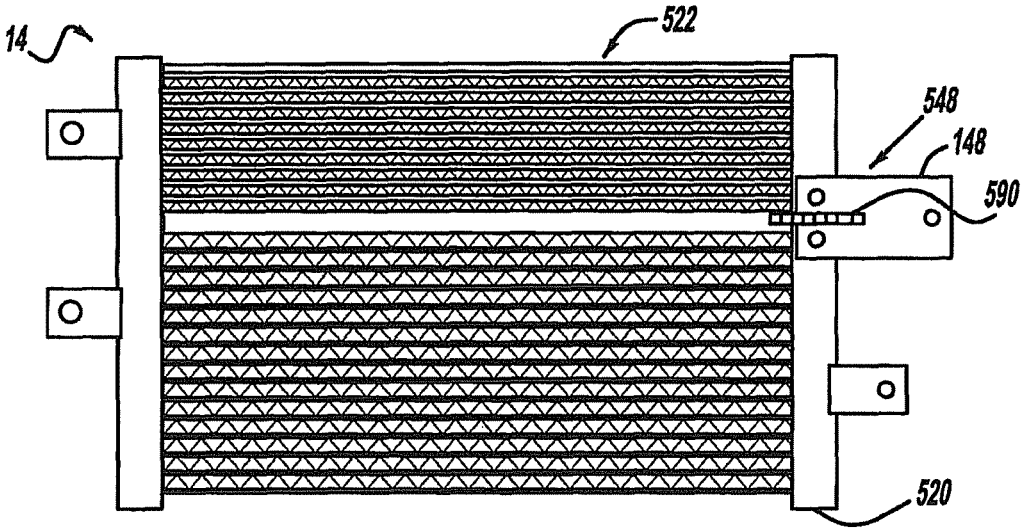
FIG. 19A is a plan view of a multi-cooler of the present disclosure before another embodiment of a saw-cut operation.
Figure 19B:
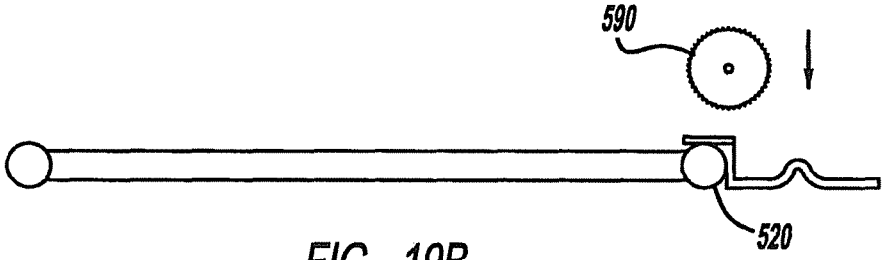
FIG. 19B is a side view of the multi-cooler of FIG. 19A.
Figure 20A:
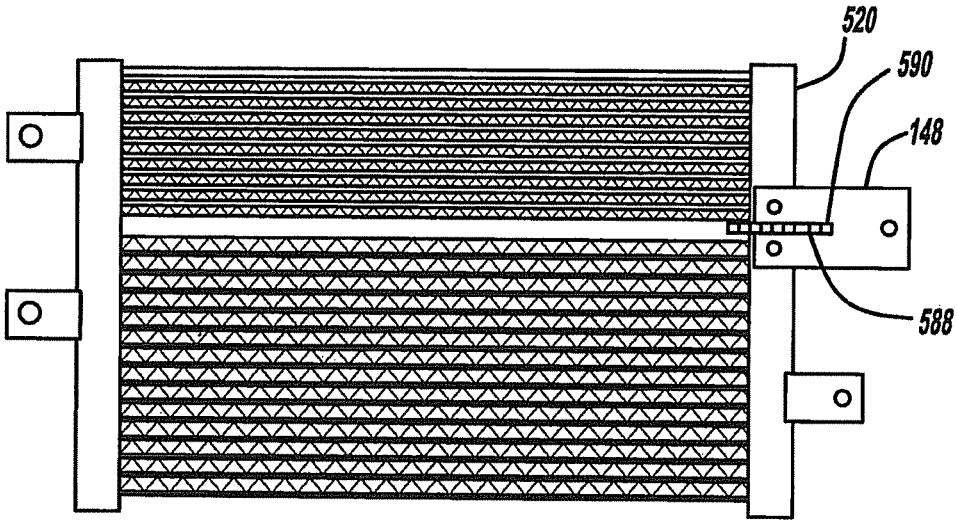
FIG. 20A is a plan view of the multi-cooler of FIG. 15A during the saw-cut operation.
Figure 20B:
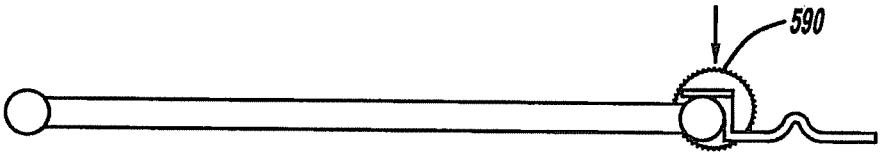
FIG. 20B is a side view of the multi-cooler of FIG. 20A.
Figure 21:
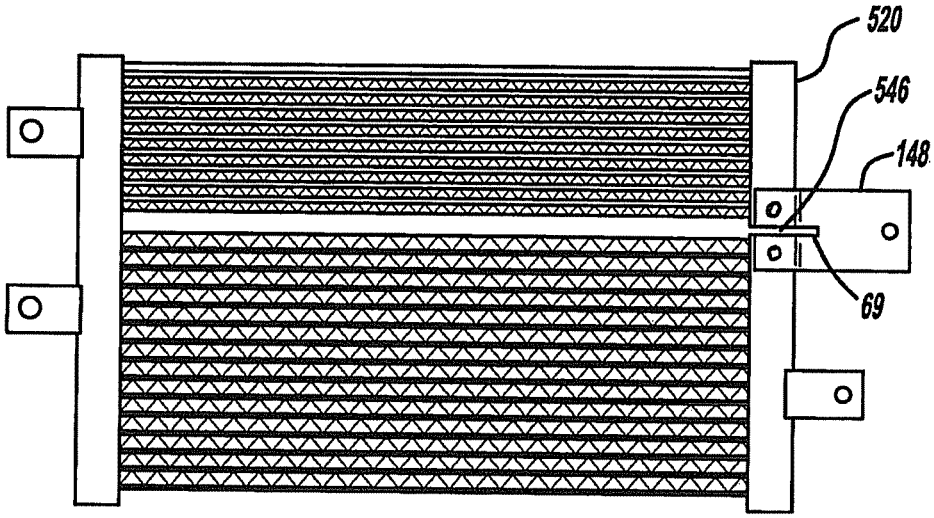
FIG. 21 is a plan view of the multi-cooler of FIG. 15A after the saw-cut operation.

Another method for manufacturing multi-cooler 14 of the present disclosure will now be described with reference to FIGS. 19 through 21. In a first operation as shown in FIG. 19A, bracket 148, 348 of the present disclosure is secured to a main core 522 of multi-cooler 14 at a saw-cut region 588 (e.g., brazing or soldering). A saw 590 is then brought into contact with bracket 148, 348 at a mid-portion 588 of bracket 148, 348, so as to separate an inlet manifold 520 (See FIG. 20). Saw 590 is then removed, leaving a saw-cut region 546 and slot 69, 369, as shown in FIG. 21.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. A bracket for stabilizing a heat exchanger, the bracket comprising:

a planar base member having a first edge, a second edge opposite the first edge, a fixed end and a relief end opposite the fixed end;

at least one flex zone disposed between the fixed end and the relief end and extending from the first edge toward the second edge of the planar base member, the at least one flex zone movable between a first, relaxed position and a second, flexed position; and a slot at a central portion of the planar base member, the slot being parallel to the first and second edges of the planar base member; wherein a first planar surface located immediately adjacent the fixed end of the planar base member, the first planar surface extending from the fixed end toward the relief end of the planar base member to a first side of the at least one flex zone and a second planar surface located immediately adjacent a second side of the at least one flex zone opposite to the first side, the second planar surface extending from the at least one flex zone toward the relief end of the planar base member;

the first planar surface is generally parallel with the second planar surface in both the relaxed position and the flexed position; and the at least one flex zone extends between the first edge and the second edge and the slot bisects the at least one flex zone.

2. The bracket according to claim 1, further comprising:

a hole adjacent the fixed end of the planar base member for receiving a first fastener, the bracket fixedly secured to a vehicle through the first fastener, the hole extending through the first planar surface.

3. The bracket according to claim 1, wherein:

the at least one flex zone extends outward from an upper surface of the planar base member and a concave surface along a lower surface of the planar base member, the concave surface creating a channel, the channel having a first face in an opposing relationship with a second face of the channel.

4. The bracket according to claim 1, wherein the first planar surface and the second planar surface are coplanar in both the relaxed position and the flexed position.

* * * * *